United States Patent [19]

Davis et al.

[11] 3,960,268

[45] June 1, 1976

[54] FRAME FOR SUPPORTING FRANGIBLE SHEET MATERIALS

[75] Inventors: Richard W. Davis, Tempe; Thomas L. Muir, Phoenix, both of Ariz.

[73] Assignee: Villa Precision, Inc., Phoenix, Ariz.

[22] Filed: Sept. 15, 1975

[21] Appl. No.: 613,359

[52] U.S. Cl. ..... 206/45.33; 206/456; 206/485; 206/497; 211/41; 211/175

[51] Int. Cl.[2] ..... B65D 75/30; B65D 65/38; B65D 85/48; A47G 29/00

[58] Field of Search ..... 206/45.33, 454, 455, 206/456, 485, 497; 211/40, 41, 13, 20, 23, 60 R, 175, 69.9; 354/337, 343, 345, 346, 347; 118/500

[56] References Cited

UNITED STATES PATENTS

| | | | |
|---|---|---|---|
| 1,660,210 | 2/1928 | Schaefer | 211/41 |
| 2,256,995 | 9/1941 | Andres | 206/485 X |
| 2,337,468 | 12/1943 | Hilger | 206/454 |
| 2,579,519 | 12/1951 | Shepard | 211/69.9 |
| 2,764,283 | 9/1956 | Stanton | 206/45.33 X |
| 2,818,166 | 12/1957 | Hill | 206/45.33 |
| 2,959,293 | 11/1960 | Von Meyer | 211/40 |
| 2,964,175 | 12/1960 | Nolte | 206/485 |
| 3,923,156 | 12/1975 | Wallestad | 211/40 X |

FOREIGN PATENTS OR APPLICATIONS

| | | | |
|---|---|---|---|
| 261,001 | 9/1964 | Australia | 206/45.33 |
| 49,880 | 11/1880 | Germany | 354/337 |
| 322,722 | 5/1919 | Germany | 354/337 |

*Primary Examiner*—William Price
*Assistant Examiner*—Stephen Marcus
*Attorney, Agent, or Firm*—Cahill, Sutton & Thomas

[57] ABSTRACT

A pair of triangular cross-section racks are maintained spaced apart from but parallel to one another by a plurality of rods slidably and retainingly engaging the racks to form a supporting frame. A plurality of diamond shaped apertures are disposed within the opposed face of each of the pair of racks to retainingly receive and support opposed corners of sheet materials mounted upon the pair of racks. The slidably engaging rods permit the spacing intermediate the racks to be adjusted to accommodate the width of the supported sheet materials and the diamond shaped apertures accommodate sheet materials of different thicknesses. Means are also described for sealingly enveloping a frame loaded with hygienically cleaned pieces of sheet material.

14 Claims, 8 Drawing Figures

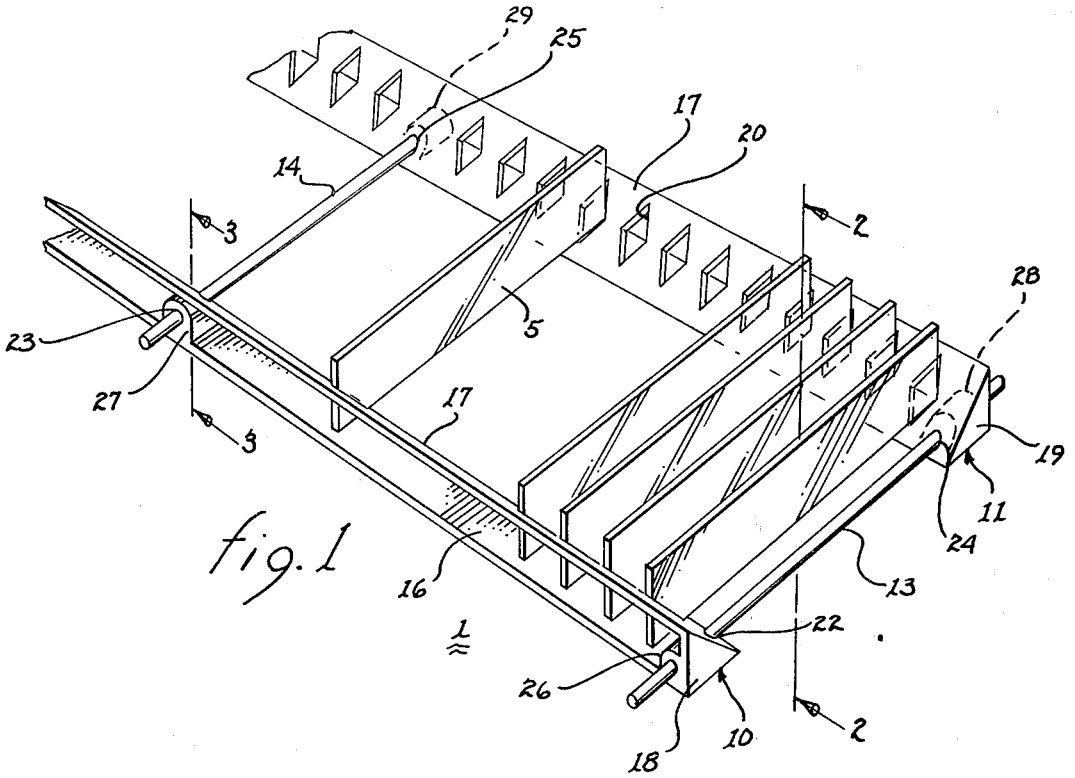
fig. 1
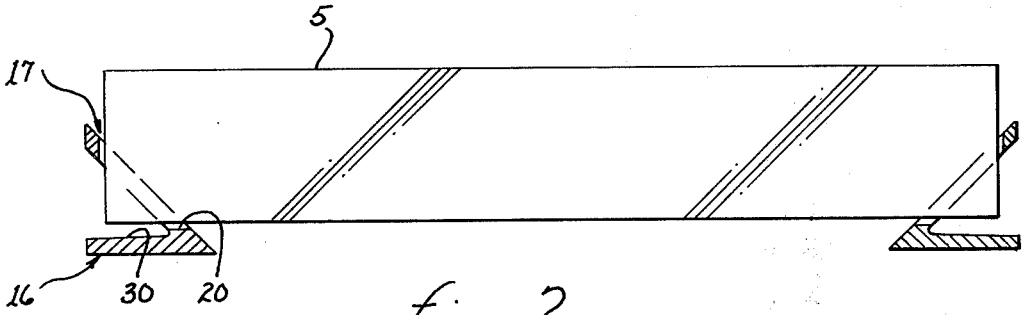
fig. 2
fig. 3
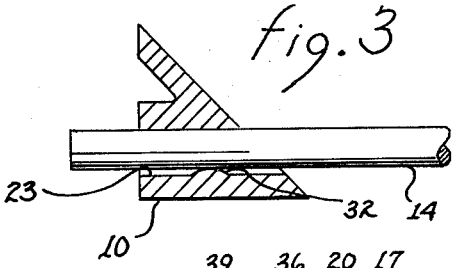
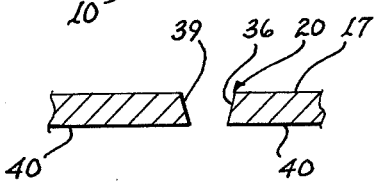
fig. 5
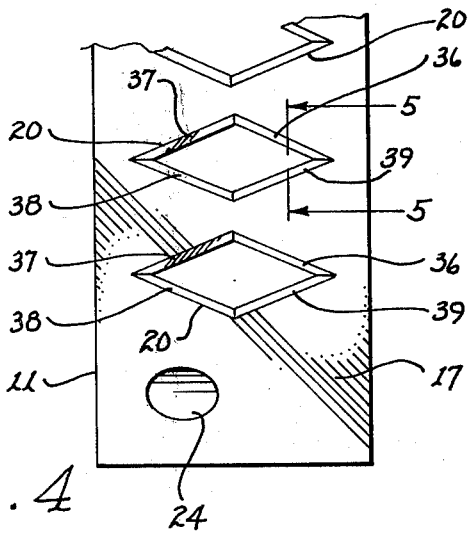
fig. 4

FRAME FOR SUPPORTING FRANGIBLE SHEET MATERIALS

The present invention relates to supporting frames and, more particularly, to supporting frames which are adjustable to accommodate a range of sheet materials which differ in width and/or thickness.

In the field of storing and transporting frangible sheet materials, such as specimen slides for microscopes, various fixed configuration containers have evolved. Typically, these containers have opposed pairs of slots for receiving the slides, which slots incorporate no retention means for frictionally preventing inadvertent removal of the slides. Some modification of the basic principles embodied within these containers have been employed in the photographic field wherein color slides (positives) are retainingly maintained within fixed opposed slots by metallic or plastic spring wipers. U.S. Pat. Nos. 2,119,407, 2,774,472, 3,480,151, 3,682,083 and T927,008 are representative of the above types of devices.

Apparatus also exists for retaining planar like members by engaging a corner of a segment of the member. In example, U.S. Pat. No. 2,337,468, illustrates a device having apertured slanted supports for engaging a corner of a sheet of material; U.S. Pat. Nos. 1,008,124 and 2,256,995 also illustrate similar devices. U.S. Pat. No. 3,486,631 describes a basket having pairs of slots oriented at an obtuse angle with respect to one another for receiving circular planar elements. U.S. Pat. No. 1,036,420 illustrates a drying rack having opposed angled planar surfaces for supporting the opposed lower corners of a vertically oriented slab and a downwardly sloping corrugated surface for engaging one of the upper corners to maintain separation intermediate adjacent slabs. U.S. Pat. No. 970,491, is directed to an adjustable rack for supporting photographic film negatives upon a horizontal corrugated surface and intermediate opposed vertical corrugated surfaces; segments of one of the vertical surfaces are adjustable to accommodate different widths of the negatives. Hence, none of the known prior art devices are constructed so as to accommodate their use in storing sheet materials of other than a predetermined width and thickness.

It therefore is a primary object of the present invention to provide a universal frame which is readily adjustable in width and which can accommodate supported sheet materials of different thicknesses.

Another object of the present invention is to provide a universal frame which is conformable to receivingly mount and store other than rectangularly shaped sheet materials.

Still another object of the present invention is to provide retaining means within a sheet material supporting frame which cushions the sheet material.

Yet another object of the present invention is to provide a frame for sheet materials which encourages drainage after cleaning.

A further object of the present invention is to provide a frame for sheet materials which may be autoclaved.

A still further object of the present invention is to provide an inexpensive rack for sheet materials.

A yet further object of the present invention is to provide a means and a process for sealing a sterile and hygienic loaded frame to prevent contamination thereof.

These and other objects of the present invention will become apparent to those skilled in the art as the description thereof proceeds.

The present invention may be described with greater specificity and clarity with reference to the following drawings, in which:

FIG. 1 is a perspective view of several specimen slides mounted upon a frame formed by a pair of racks interconnected by a plurality of rods.

FIG. 2 is a side view of the frame taken along lines 2—2, as shown in FIG. 1.

FIG. 3 is a cross-sectional view taken along lines 3—3, as shown in FIG. 1.

FIG. 4 is a partial top view of one end of a rack shown in FIG. 1.

FIG. 5 is a cross-sectional view taken along lines 5—5, as shown in FIG. 4.

Figure 6:
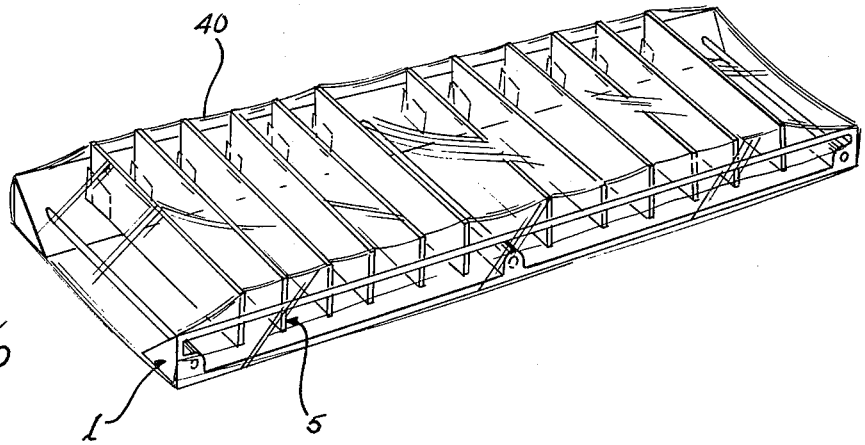
FIG. 6 illustrates a loaded frame enclosed within a protective envelope.

Referring to FIG. 1, there is shown a frame 1 for supporting in a vertical orientation a plurality of planar elements, such as specimen slides 5. The frame is formed by a pair of opposed racks 10 and 11. These racks are interconnected with one another by means of at least a pair of rods 13 and 14.

The racks are triangular in cross-section and include a horizontally oriented planar base 16 and a planar sloping side 17. End pieces, like walls 18 and 19, maintain the orientation between the base and the side. A plurality of diamond shaped apertures 20 are disposed within side 17. They are oriented to have the minor axis parallel to the longitudinal axis of the rack and the major axis transverse to the rack. Rack 10 includes circular passageways 22 and 23 disposed within bosses 26, 27 for receiving one end of rods 13 and 14, respectively; similarly, rack 11 includes passageways 24 and 25 disposed within bosses 28, 29 for receiving the other end of rods 13 and 14, respectively. These passageways are configured to exert sufficient interference with the penetrating rod to prevent inadvertent or unwanted sliding of the rod into or out of its respective passageway. The bosses serve as additional structural elements to maintain the spatial relationship between base 16 and side 17. It may be appreciated that the racks are not permanently attached to the rods and that the frame is dismantlable and reassemblable at any time.

Slides 5, which may be of any thickness up to the width of apertures 20, are mounted within frame 1 by positioning the lower corners of a vertically oriented slide within opposed apertures of each rack. The penetration of the slide into aperture 20 is a function of the thickness of the slide as penetration will continue until each of the four edges (36, 37, 38 and 39, see FIG. 4) of aperture 20 is in engagement with one of the corner edges of the slide. After insertion of slides 5, and upon the assumption that racks 10 and 11 have been spaced apart from one another upon rods 13 and 14 at a distance approximately commensurate with the length of the slides, the racks are slid toward one another upon the rods to cause a slight deformation of the inside surfaces of aperture 20 bearing against the slide. The slight deformation of the inner sides of aperture 20 tends to create a retaining force to maintain the slide in firm engagement with the racks. Because of the interference fit between rods 13 and 14 and the attached racks, the racks will tend to remain at a fixed distance from one another and continue to exert a retaining force upon the mounted slides.

From the above description, it will be appreciated that frame 1 is specifically configured to be adaptable for retaining any group of specimen slides provided that the thickness of each slide is less than the width of apertures 20 and that the length of the slide be commensurate with the length of rods 13 and 14. Thus, frame 1 is adaptable to almost any sized slide used in the industry. Because of the diamond like configuration of apertures 20, any configuration of sheet material and not just specimen slides can be mounted within frame 1. The only constraint imposed is that the peripheral configuration of the sheet material permits partial penetration of opposed apertures in the pair of racks.

In one configuration of frame 1, apertures 20 were sized such that full penetration of the corner of the slide 5 would occur if the thickness of the slide were ten thousandths of an inch or less. Moreover, penetration of approximately one eighth of an inch would occur with a slide having a thickness of approximately seventy thousandths of an inch. This range of thickness encompasses most generally commercially available specimen slides and it may be appreciated that a single frame can accommodate a substantial range of slide thicknesses.

Several subtleties of the present invention are best illustrated with reference to FIG. 2. All three surfaces of side 17 are other than horizontal. The inner surfaces forming aperture 20 are other than horizontal. The upper surface 30 of base 16 is configured to have a slope of approximately 2°. Thereby, all of the surfaces (except the lower surface of base 16) slope with respect to a horizontal plane and thereby promote drainage of a cleaning solution within which the rack or frame may have been temporarily immersed. The fact that the lower surface of base 16 does not inherently promote drainage or run-off is not deemed crucial as that surface is sufficiently physically removed from the supported sheet materials to preclude contact therebetween.

FIG. 3 best illustrates the compression ridge 32 disposed within passageway 23. This ridge, upon penetration of rod 14 within the passageway, interferes with the rod and becomes compressed to a slight degree. The resulting force exerted upon rod 14 tends to establish a sufficient force to retain rack 10 in position with respect to the rod.

FIGS. 4 and 5 more succinctly illustrate the configuration of apertures 20 and the means by which they serve to engage the penetrating portion of a slide 5. By experimentation it has been learned that a diamond configuration having acute angles of approximately 30° is particularly accommodatable for a wide range of slide thicknesses in conjunction with an exertable gripping or retaining force. The inner surfaces 36, 37, 38 and 39 of aperture 20 are oriented to slope inwardly at an angle of approximately 75° with respect to the plane defined by side 17. In a cross-sectional view of aperture 20, as shown in FIG. 5, surfaces 36 and 39 and the lower surface 40 of side 17 establish resiliently deformable acute angled edges for continually exerting pressure upon the edges of a penetratingly inserted corner of slide 5. Thereby, a continuous force acts upon the slide to retain it within aperture 20. Moreover, the edges tend to cushion the slides against shock with reduced damage due to handling or transport.

Preferably, racks 10 and 11 and rods 13 and 14 are molded or otherwise mass produced from a plastic composition selected from the broad range of plastic materials. With such selection, the degree of firmness of the racks can be specifically determined to accommodate the stiffness of the racks along their longitudinal axis and also a degree of deformability of the edges within the apertures commensurate with the fragility of the planar elements to be supported by the racks. By using a plastic composition, the frame can be autoclaved without danger of damage and most cleaning solutions are compatible therewith. Hence, the frame can be rendered as sterile as the components supported thereon.

Because racks 10 and 11 are identical and interchangeable with one another, substantial manufacturing economies can be effected. Moreover, the rods are produced by well known inexpensive techniques. Hence, the cost of producing the components of frame 1 is extremely low and renders the resulting frame economically disposable after use.

Because frame 1 can accommodate a wide range of sizes and thicknesses of the elements to be mounted thereupon, the stocking of a plurality of different sizes by facilities utilizing the frame is eliminated. Thereby, further savings in storage costs can be effected. Additionally, the takedown capability minimizes the volumetric storage needs.

Once the slides or other elements to be supported upon racks 10 and 11 have been mounted and the racks are firmly interconnected to one another by rods 13 and 14, the ends of the rods extending lateral to the racks are snipped off. This does not affect the retention capability of the frame. The resulting lack of protruding elements minimizes the lateral size of the loaded frame and the attendant packaging and shipping constraints.

Normally, when hygienically sterile planar elements, i.e. specimen slides, are transported from one location to another, the elements are individually wrapped within a protective envelope. On arrival at the destination, the elements must be unwrapped prior to use. Such wrapping and unwrapping is time consuming and expensive; for very small elements, it creates a substantial percentage size increase and resulting shipping problem. For reasons described below, frame 1 obviates the need for individual wrapping of the stored elements while retaining the capability of storing and transporting hygienically sterile mounted elements.

FIG. 6 illustrates a frame 1 loaded with a plurality of specimen slides 5. The frame and the loaded slides are enclosed within a heat shrinkable envelope 40. The envelope serves to shield the slides against contamination and serves, after being partially shrunk, to retain the slides within the frame by preventing any movement of the slides with respect to one another or with respect to the frame. The resulting module is essentially completely rectangular in shape which permits it to be easily packaged within a shipping carton or stored upon shelves. Furthermore, the shape of the module allows it to be readily handled and otherwise carried by technicians.

Several methods may be employed for enclosing the loaded frame within an envelope. However, it has been learned that the below described procedure produces particularly satisfactory results. The loaded tray is inserted intermediate a folded thin sheet of plastic material transverse to the fold. By using heated element techniques, the sides of the folded sheet are annealed to one another adjacent the longitudinal edges of the loaded tray but for a distance less than the full width of the folded sheet. The excess of the plastic envelope adjacent one end of the loaded tray is folded downwardly and back along the bottom of the tray to seal the open end of the envelope. The enveloped loaded tray is subjected to a heat source to produce a slight shrinkage of the envelope, as depicted in FIG. 6. The slight shrinkage exerts a continuous pressure upon slides 5 to retain them in place and aids in preventing any lateral shifting of the slides with respect to one another.

Figure 7:
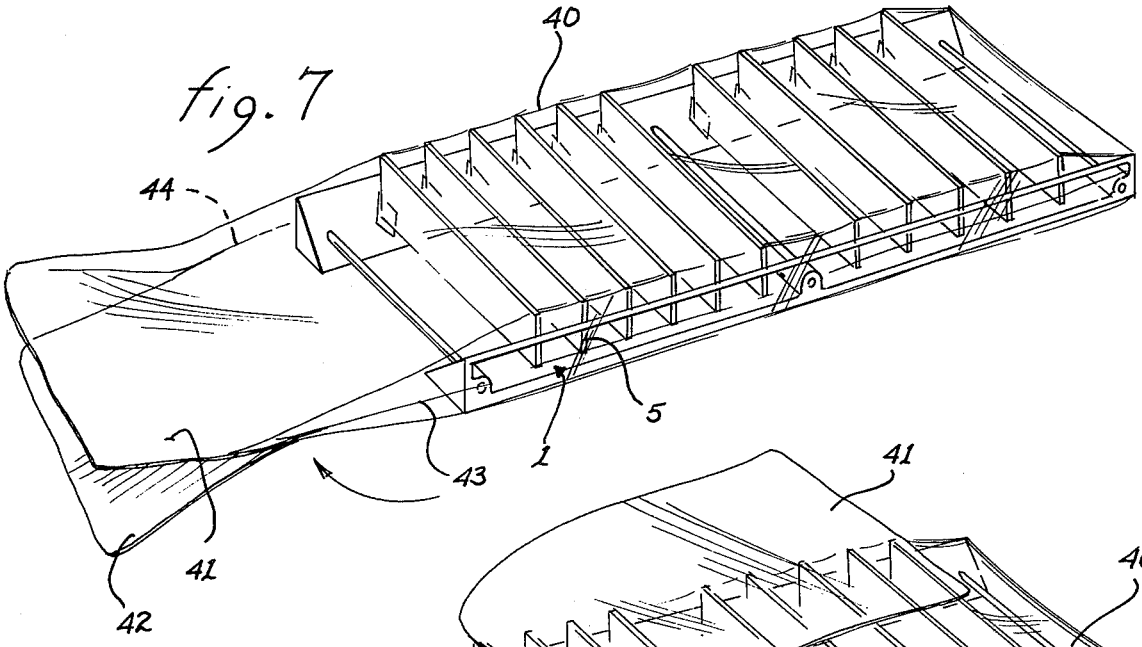
FIG. 7 depicts the step for severing the envelope from about a loaded frame.
Figure 8:
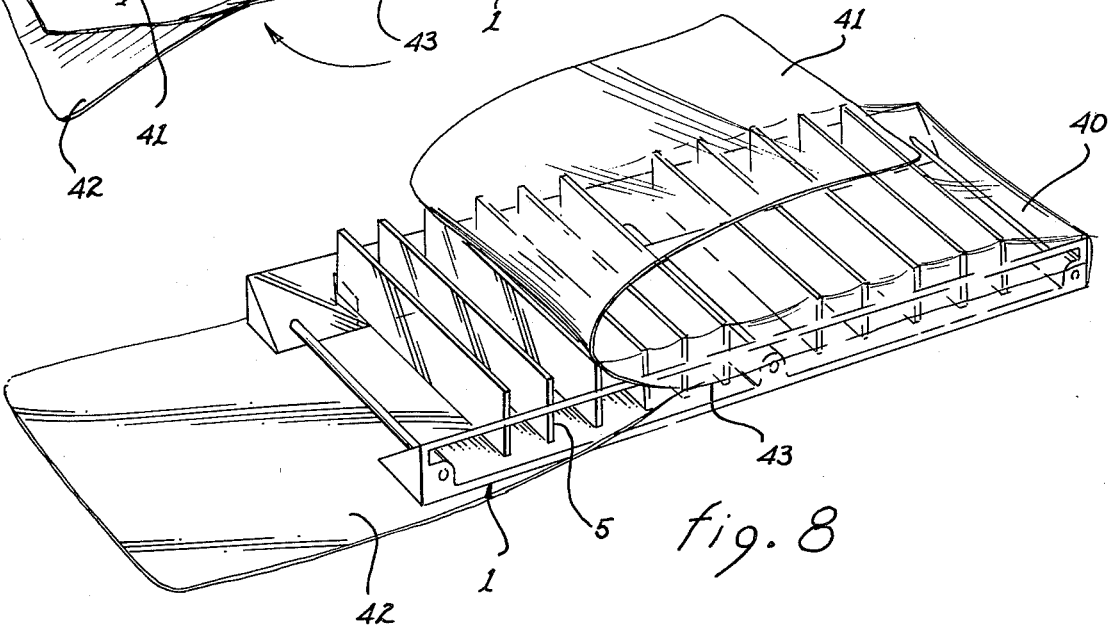
FIG. 8 depicts the step for peeling the envelope from about a loaded rack.

To use a sealed loaded frame, a technician grasps the folded under section of the envelope and unfolds it into general alignment with the frame, as illustrated in FIG. 7. The flapped ends 41 and 42, which ends result because the annealing is terminated short of the edges of the folded sheet, are grasped by the technician. On exertion of a force to pull ends 41 and 42 apart from one another, the upper and lower sheet of the envelope will be severed from one another along annealed edges 43 and 44 to expose slides 5, as illustrated in FIG. 8.

From the above description, it will be appreciated that slides 5 are storable and transportable in a sterile state while employing a relatively inexpensive envelope for enclosing a loaded frame. Moreover, the envelope is removable without the necessity of handling any of the slides mounted upon the frame.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. A frame for supporting and retaining sheet materials, said frame comprising in combination:

a. a pair of racks positioned adjacent one another in an opposed relationship for receiving and engaging portions of the sheet materials, each rack of said pair of racks including a base, a sloping side and at least a pair of passageways extending transversely through said rack in general planar alignment with said base;

b. a plurality of apertures disposed within said sloping side of each said rack for receivingly engaging penetrating portions of the sheet materials, each said aperture being diamond shaped and having the major axis transverse to said rack and the minor axis in general alignment with said rack;

c. at least two rods for interconnecting said racks of said pair of racks and maintaining said racks spaced apart from one another with the sloping sides thereof facing one another, each of said rods engaging a passageway within each of said racks; and d. interference means disposed intermediate said rods and the respective ones of said passageways for establishing an interference fit therebetween to restrain inadvertent change in spacing intermediate said racks of said pair of racks.

2. The frame as set forth in claim 1 wherein said passageways extend into said racks through said sloping sides.

3. The frame as set forth in claim 2 including a boss disposed about each of said passageways for adding structural integrity intermediate said base and said sloping side of said racks.

4. The frame as set forth in claim 3 wherein said interference means comprises a ridge disposed within each said passageway for establishing an interference fit between said rods and the engaged ones of said passageways.

5. The frame as set forth in claim 4 wherein the acute angle of said diamond shaped apertures is 30°.

6. The frame as set forth in claim 5 wherein the side surfaces of said diamond shaped apertures slope inwardly at an angle of 75° with respect to the plane of said sloping side.

7. The frame as set forth in claim 6 wherein the cross-section of each said rack represents a triangle.

8. The frame as set forth in claim 7 wherein said racks and said rods are of plastic material to accommodate compression of said ridges within said passageways by said rods and elastic deformation of the side surfaces of said apertures upon mounting of the sheet materials.

9. The frame as set forth in claim 1 wherein the acute angle of said diamond shaped apertures is 30°.

10. The frame as set forth in claim 9 wherein the side surfaces of said diamond shaped apertures slope inwardly at an angle of 75° with respect to the plane of said sloping side.

11. The frame as set forth in claim 10 wherein the upper surface of said base slopes downwardly from the junction of said base and said sloping side at an angle of 2°.

12. The frame as set forth in claim 1 including a removable envelope for sealingly enclosing said frame and the sheet materials mounted thereon.

13. The frame as set forth in claim 12 wherein said envelope comprises a folded sheet of plastic material to cover one end and the top and bottom of said frame with the respective edges of said plastic material being annealed along the sides of said frame.

14. The frame as set forth in claim 13 wherein said plastic material adjacent the other end of said frame is folded and positioned along the bottom of said frame to sealingly enclose said frame within said envelope.

* * * * *